US010986706B2

(12) United States Patent
Frey et al.

(10) Patent No.: US 10,986,706 B2
(45) **Date of Patent: *Apr. 20, 2021**

(54) MICROWAVE COOKING OVEN WITH AN ADJUSTING DEVICE FOR ADJUSTING A MICROWAVE SHIELD

(71) Applicant: BSH Hausgeräte GmbH, Munich (DE)

(72) Inventors: Mathias Frey, Rosenheim (DE); Robert Pietsch, Traunreut (DE)

(73) Assignee: BSH Hausgeräte GmbH, Munich (DE)

( * ) Notice: Subject to any disclaimer, the term of this patent is extended or adjusted under 35 U.S.C. 154(b) by 259 days.

This patent is subject to a terminal disclaimer.

(21) Appl. No.: 15/997,733

(22) Filed: Jun. 5, 2018

(65) Prior Publication Data

US 2018/0288838 A1 Oct. 4, 2018

Related U.S. Application Data

(63) Continuation of application No. 14/637,419, filed on Mar. 4, 2015, now Pat. No. 10,021,740.

(30) Foreign Application Priority Data

Mar. 19, 2014 (DE) ..... 10 2014 205 113.4
Aug. 20, 2014 (DE) ..... 10 2014 216 557.1

(51) Int. Cl.
*H05B 6/76* (2006.01)
*H05B 6/64* (2006.01)

(52) U.S. Cl.
CPC ..... *H05B 6/763* (2013.01); *H05B 6/6414* (2013.01)

(58) Field of Classification Search
CPC ..... H05B 6/6414; H05B 6/763
USPC ..... 219/741, 742, 744, 754, 762, 756, 722, 219/723, 739, 740; 174/382, 374, 377; 126/200
See application file for complete search history.

(56) References Cited

U.S. PATENT DOCUMENTS

| | | | |
|---|---|---|---|
| 3,329,795 A | 7/1967 | Long | |
| 3,767,884 A | 10/1973 | Osepchuk et al. | |
| 2004/0056028 A1 | 3/2004 | Kim et al. | |

FOREIGN PATENT DOCUMENTS

| | | | | |
|---|---|---|---|---|
| DE | 3409563 A1 | 9/1985 | | |
| DE | 102004048000 A1 * | 4/2006 | ..... | F24C 15/023 |
| EP | 1648203 A2 | 4/2006 | | |
| JP | 2003109745 A | 4/2003 | | |

OTHER PUBLICATIONS

Translation of DE3409563A, Microwave oven, Sep. 19, 1985, European Patent Office. (Year: 1985).*
National Search Report DE 10 2014 216 557.1 dated Nov. 10, 2014.

* cited by examiner

*Primary Examiner* — Quang T Van
(74) *Attorney, Agent, or Firm* — Michael E. Tschupp; Brandon G. Braun; Andre Pallapies

(57) ABSTRACT

A microwave oven includes a housing, which surrounds an oven space and has a flange configured to delimit a loading opening for the oven space. A door closes off the oven space and is disposed movably on the housing. Disposed on the door is a microwave shield, which is disposed at a distance in front of the flange, when the door is closed and is adjusted by an adjustment facility such that a position of the microwave shield can be set in three spatial directions relative to the flange.

22 Claims, 5 Drawing Sheets

MICROWAVE COOKING OVEN WITH AN ADJUSTING DEVICE FOR ADJUSTING A MICROWAVE SHIELD

CROSS-REFERENCE TO RELATED APPLICATION

This application is a continuation, under 35 U.S.C. § 120, of U.S. application Ser. No. 14/637,419, filed Mar. 4, 2015, which claims the priority, under 35 U.S.C. § 119, to German Application No. 10 2014 216 557.1, filed Aug. 20, 2014 and to German Application No.: 10 2014 205 113.4, filed Mar. 19, 2014.

BACKGROUND OF THE INVENTION

The invention relates to a microwave oven with a housing which surrounds an oven space and delimits a loading opening of the oven space by a flange. The microwave oven comprises a door for closing off the oven space which is disposed movably on the housing. In addition the microwave oven has a microwave shield, which is disposed on the door and in the closed state of the door at a distance in front of the flange. In addition the microwave oven has an adjustment facility for adjusting the position of the microwave shield.

Such a microwave oven is known from EP 1 648 203 A2.

For ovens operated with high-frequency microwave energy there is a strict requirement that, during the operation of the microwave oven, the escape of microwave energy through the gap which is always present between housing and door is kept as low as possible. To this end what is referred to as microwave trap is provided in which a short circuit is generated for the microwave present in the door gap area. The microwave shield is provided and its functions are embodied for this purpose.

In order to now minimize this escape of microwave energy, the position of the microwave shield is to be set very precisely. Since a plurality of components is located adjacent to the microwave shield in the microwave oven, there can also be corresponding positional tolerances to consider during this process.

BRIEF SUMMARY OF THE INVENTION

It is an object of the present invention to create a microwave oven in which the escape of microwave energy during operation of the oven can be further reduced by the positioning of the microwave shield.

An inventive microwave oven comprises a housing, which surrounds an oven space and delimits a loading opening of the oven space by a flange. The microwave oven further has a door for closing off the oven space, which is disposed movably on the housing. A microwave shield of the microwave oven is disposed on the door, and at a distance in front of the flange in the closed state of the door, wherein it is able to be set in its position with an adjustment facility. A major idea of the invention is to be seen as the adjustment facility being embodied such that the microwave shield is able to be set in its position in all three spatial directions relative to the flange. Such an embodiment of the adjustment facility thus enables extremely exact and fine adjustment of the position of the microwave shield to be undertaken in relation to a number of other components present in the environment of the microwave shield in the closed state of the door. A possible escape of microwave energy during the operation of the microwave oven is significantly reduced by this.

In a preferred version the adjustment facility has a carrier part of the door, on which the microwave shield is disposed movably in at least two spatial directions, especially in two spatial directions in a plane parallel to the microwave shield, able to be changed in its position relative thereto and is accordingly able to be moved. This embodiment basically makes possible a mechanically stable accommodation of the microwave shield, since the corresponding carrier part of the door is embodied robustly and is intended in its functional use to accommodate further components of the door itself. This embodiment makes a fitting of the microwave shield possible which makes possible an attachment which provides for undesired flexing. Through this attachment to the carrier part the microwave shield can therefore be disposed as level as possible at least in a plane in parallel to the carrier part. In addition the ability to attach the microwave shield to this carrier part such that its position can be changed also makes possible an embodiment that, in a reversibly repeatable and low-wear manner, enables a different relative position to be set between the said parts. Since the carrier part is also inherently stable, even with a large microwave shield, the relative position then set between the two parts is retained permanently and reliably, so that a distance between the microwave shield and the flange of the housing can also be adjusted precisely and so as to remain the same permanently.

Even if the door is moved frequently and its opening and closing cause jerky mechanical forces to act on the microwave shield, the relative position in relation to the carrier part remains stable.

Preferably the microwave shield is disposed on the carrier part so as to be able to be released in a non-destructive manner. A screw connection can be provided here for example. Through this embodiment there can be dismantling into individual components or parts for the purposes of installation, maintenance or replacement. This facilitates access. Likewise the replacement of individual parts can be made possible without the entire module having to be replaced.

In a preferred manner the carrier part is embodied as a plate. This produces advantages in respect of installation space viewed in the depth direction of the microwave oven, since this plate is embodied very flat or thin. On the other hand such a construction enables a particular torsional stiffness to be achieved, which then takes positive account of the above advantages to a particular extent. In addition a versatile attachment and fitting option for the microwave shield is also created by such a plate-type embodiment, so that here too account can also be taken of the above advantages in a favorable manner.

Preferably there is provision for the carrier part to have holes through which a respective fastening element for fastening the microwave shield to the carrier part can pass. In this case there is especially provision for an internal diameter of the holes to be larger by at least 1.2 times, especially 1.5 times, preferably at least 2 times than an external diameter of the sub part of the fastening element which extends through the hole in the installed state. This embodiment is especially advantageous in that it makes it possible to install the microwave shield on the carrier part in a simple manner, on the other hand it makes possible the versatile positioning of the microwave shield in a plane parallel to the carrier part and also to the microwave shield relative to the carrier part. A movement in these two spatial directions can thus be undertaken continuously and very individually as well as with fine adjustment. The hole size is thus not only to be dimensioned so that the fastening element can extend through it with a relatively tight fit, but in this context makes possible a play in movement before the fastening of the fastening element in this hole going beyond this in these two first spatial directions in which the plane extends in parallel to the microwave shield and to the carrier part. Through this not only an exclusively provided movement of the relative position in one spatial direction can occur but also simultaneously in two spatial directions, so that also a certain tilting of the microwave shield relative to the carrier part can be set.

Preferably there is provision for the adjustment facility to have a distance setting device which is embodied for setting a relative position between the microwave shield and the flange in a third spatial direction measured in a depth direction of the microwave oven, which is at right angles to the two previously-mentioned first and second spatial directions. In terms of specific components, the adjustment facility in this preferred embodiment manifests itself by a number of individual components being present which make it possible to set the relative position of the microwave shield to the flange and in this context then also to the carrier part of the door individually. This too favors very precise positional setting once more, since the setting options in the three spatial directions are not necessarily linked to one another but practically each individual direction of the three spatial directions can then be changed individually.

Preferably there is provision for the distance setting device to have at least one distance element which extends in a free space between the microwave shield and a carrier part of the door on which the microwave shield is disposed. This embodiment takes up minimum installation space since the distance element does not undesirably extend beyond a free space present in any event. In addition the permanently reliable retention of the set relative position is achieved by such a distance element and held mechanically stably. In addition the distance element, through its specific positioning in the free space, is also disposed protected to a certain extent and cannot be displaced undesirably by direct undesired impact.

Preferably there is provision for the fastening element in the third spatial direction to extend through the distance element in the axial direction and for the two elements to be guided within one another. An embodiment very much minimized in terms of installation space is also created by this. Above and beyond this the distance element is also almost provided as a shroud and guide for the fastening element. This makes a very targeted and rapid installation possible. The result achieved by this embodiment is also that a quasi-mechanical coupling and action principle is formed in which the individual separate elements support and hold each other mutually and thus contribute in a positively-supporting way to the permanently set relative position.

Preferably there is provision for the distance element to be embodied asymmetrically in its shape in at least one spatial direction and to be movable in the free space between the microwave shield and the carrier part in a plane parallel to the carrier part and the microwave shield. Depending on the position of the distance element in relation to the microwave shield and the carrier part, a distance in the third spatial direction is able to be changed. This design enables a finely-adjusted positional change to be achieved even when the microwave shield is embodied uneven in some areas. Even then the asymmetrically-embodied distance element allows a desired distance to be set and maintained in the third spatial direction.

Preferably there is provision for the distance element to be embodied in the shape of a wedge at an end of its longitudinal extent measured in the third spatial direction and to rest with this end on an angled inner side of the microwave shield, wherein the change in distance in this third spatial direction is created by relative movement of the end of the distance element along the angled inner side. In that this distance element is thus moved in the first and/or second spatial direction, a distance change in the third spatial direction at right angles thereto is able to be set and fixed. Precisely when the fastening element extends in the direction of the longitudinal axis of the distance element through said element, especially is guided through a bore of the distance element, a corresponding position fixing by the fastening element can then also be achieved with this wedge-shaped design and the contact between the wedge-shaped end and the angled inner side can be fixed. Through the fastening element the microwave shield and the carrier part are tensioned and positionally fixed to one another at least in the third spatial direction in the desired installed end state.

Preferably there is provision for the distance element, in an alternative version for distance setting, to be inherently able to be varied in its length, especially reversibly variable in its length in the third spatial direction. This means that in the third spatial direction, in which the longitudinal axis of the distance element also extends, a compression and expansion is made possible. The distance element can shorten and lengthen, through which a change in distance in this third spatial direction between the microwave shield and the carrier part and thus also automatically between the microwave shield and the flange of the housing is able to be set.

This too is a version which makes possible a very finely-adjusted setting of a distance, on the other hand allowing this set distance to be permanently maintained.

In a version of such a variable-length distance element there is provision for said element to be a spring, especially a spiral spring. Here too there is provision in a preferred version for the fastening element to extend through the spiral spring and thus for these two components to be disposed engaging within one another.

Preferably there is provision, in a further exemplary embodiment, for the distance element to have two sub-elements able to be moved in the third spatial direction relative to one another. A first sub-element in this case is disposed in a fixed location on the microwave shield, wherein a connection that can be released without destroying it is advantageous here. For example this first sub-element can be screwed into a receptacle of the microwave shield. However a connection that cannot be released non-destructively can be provided. For example the connection can be welded on or glued on here.

The first sub-element is thus intended for mechanical connection to the fastening element at a fixed location and for this purpose has a corresponding receiving area for the fastening element. In particular, when the fastening element has a threaded area for screwing it in, the receiving area has a corresponding mating thread.

The distance element has a second sub-element, which essentially extends into the free space between the microwave shield and the carrier part, wherein this second sub-element then engages into the first sub-element to couple with it. Here too a screw connection is preferably provided between the two sub-elements, so that by screwing them together or apart, a very finely-adjusted change in length of the distance element as a whole can be made. Since just such mechanical embodiments of the coupling between the sub-elements on the one side and the sub-element with the fastening element on the other side are embodied, these are very robust and resilient and also permanently easy to operate.

Preferably there is provision, with a further advantageous embodiment, for the fastening element to have the distance element integrated into it. In such an embodiment not only a plurality of separate components is thus available, but it is practically provided in a single item.

In a preferred embodiment there is provision for this purpose for the fastening element to have a layered base section, at one end of which an anchoring region for fastening in the microwave shield is embodied, and to have a plate-shaped collar running at least partly around the base section which is supported on an inner side of the carrier part facing towards the microwave shield. A distance in the third spatial direction between the microwave shield and the carrier part in this version is then able to be set as a function of the relative position of the anchoring area in a receptacle in the microwave shield. The anchoring area is preferably again designed with a thread, which is able to be screwed into a mating thread of the receptacle in the microwave shield.

To be able to improve the fixing of the position between the microwave shield and the carrier part in relation to the distance setting in the third spatial direction, there is preferably provision for the base section, at an end lying opposite the anchoring area, to have a coupling area for the fixing element. The fixing element is embodied as a separate component to the integral element including the distance element and the fastening element. The fixing element is embodied for fixing the set position of the fastening element and is disposed resting against an outer side of the carrier part facing away from the microwave shield in the installed state. Preferably the coupling area is also realized by a thread here, to which a fixing element especially embodied as a nut can be screwed.

In a further alternate embodiment there is provision for the distance element to be embodied as a type of plug and to extend with a front spreadable end into a receptacle in the microwave shield. With a rear end of the bow-shaped distance element, on which a claw is formed, this distance element is supported against an inner side of the carrier part of the door facing away from the microwave shield. The fastening element extends in the third spatial direction through the distance element, wherein the distance in the third spatial direction between the microwave shield and the carrier part is able to be set by the penetration depth of the front end of the distance element into the receptacle and fixed by introducing the fastening element into the front end of the distance element in the receptacle by spreading out the front end. A form-fit connection between the deformed plug-type distance element and the microwave shield is also to be created. The plug tip widened outwards or the spreadable front end in particular establishes a force fit with the receptacle in the microwave shield.

This too makes possible a reliable-hold and very precise distance setting in this third spatial direction, which is mechanically robust and is easy to set and to handle.

In a further alternate embodiment there is provision for the distance element to be integrated into the microwave shield and to be embodied as an edge-side U-shaped bent tab able to be deformed in the third spatial direction. The fastening element extends through this tab in the third spatial direction through both arms of the U-shape, wherein one arm of the U shape rests on an inner side of the carrier part of the door facing towards the microwave shield. Through this embodiment, precisely through the U-shape, a certain deformation flexibility and a movement towards one another of the U arms or a movement away from one another of these U arms in the third spatial direction is achieved, so that a change in distance in this third spatial direction can also be made with very fine adjustment. In that precisely this fastening element with its lengthwise extension which is in the third spatial direction is connected with two arms of the U shape means that this deformation of the U shape is likewise possible in a very precise manner.

Preferably there is provision for this microwave shield to have this bending tab with a cut thread on the free end, through which the fastening element extends and into which it is able to be screwed. Preferably this embodiment of the tab with the U-shape is pre-bent and embodied before installation to the necessary degree of adjustment. Preferably the carrier part is then subsequently placed onto this tab and the fastening element, especially a screw, is screwed in. As soon as this screw strikes the microwave shield again, especially the arm of the U shape which extends at a distance from the carrier part, a further thread is made. Preferably a self-cutting or self-tapping screw is then provided as the fastening element.

Further features of the invention emerge from the claims, the figures and the figure description. The features and feature combinations given here in the description as well as the features and feature combinations given subsequently in the figure description and/or shown in the figures alone are not only able to be used in the respective specified combination but also in other combinations or on their own, without departing from the scope of the invention. Thus versions of the invention are also to be viewed as included and disclosed which are not explicitly shown and explained in the figures, but which emerge and are able to be created from separate feature combinations from the explained versions.

BRIEF DESCRIPTION OF THE DRAWINGS

Exemplary embodiments of the invention are explained in greater detail below on the basis of schematic drawings, in which.

DETAILED DESCRIPTION OF EXEMPLARY EMBODIMENTS OF THE PRESENT INVENTION

Figure 1:
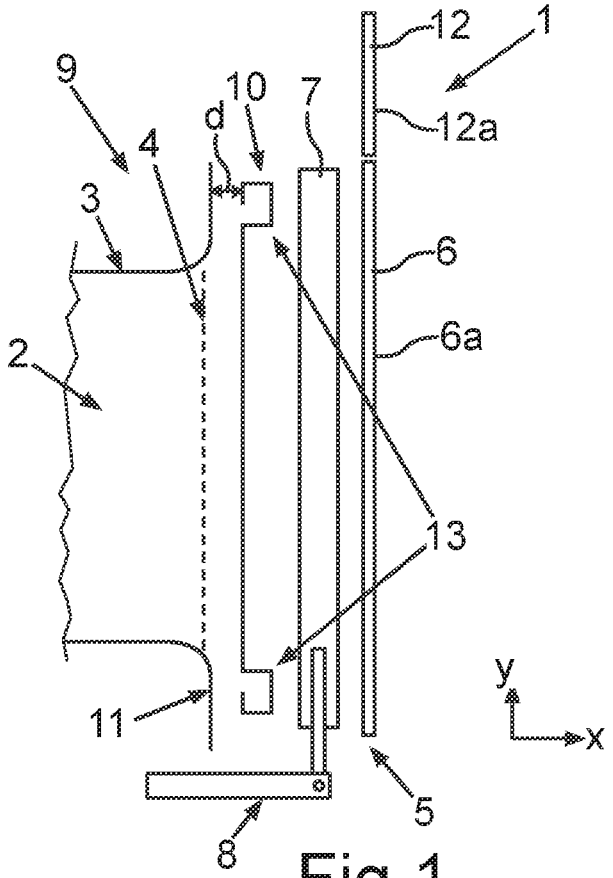
FIG. 1 shows a horizontal sectional view of an exemplary embodiment of an inventive microwave oven.

In the figures the same elements or elements with the same function are labeled with the same reference characters.

FIG. 1 shows a schematic horizontal sectional diagram of a microwave oven 1. The microwave oven 1 comprises an oven space 2 which is delimited by walls of a muffle 3. On the front side and thus facing towards a user the muffle 3 has a loading opening 4, through which items to be cooked can be introduced into the oven space 2. The loading opening 4 is able to be closed off on the front side by a door 5, wherein the closed state is shown in FIG. 1. The door 5 includes a door plate 6 disposed on the outer side or the front side respectively, which can be a viewing window for example. In addition the door 5 comprises a carrier part 7, to which hinges 8 of the door 5 are coupled, so that the door 5 as a whole is able to be hinged around an axis standing at right angles to the plane of the figure relative to the rest of the device and thus especially to the muffle 3 and a housing 9 not shown in any greater detail.

The carrier part 7 is preferably embodied as a plate. On the side of the carrier part 7 facing towards the oven space 2 a microwave shield 10 is disposed and is fastened to the carrier part 7. The microwave shield 10 is disposed spaced at a distance away from a flange 11 of the muffle 3, wherein the flange 11 is especially embodied running around the entire circumference and thus represents the edge of the loading opening 4 and delimits said opening.

In addition a device front 12 is shown in FIG. 1, which for example is a control panel and is disposed on the housing 9. As can be seen in FIG. 1, there is preferably provision for an outer side 12*a* of the device front 12 to be flush in the vertical direction and thus in the y direction with an outer side 6*a* of the front plate 6 of the door 5.

In particular there is provision for a distance d between the flange 11 and the microwave shield 10 to be set so that, in operation of the microwave oven 18, the smallest possible amount of microwave energy leaks from the oven space 2.

There is provision for the microwave oven 1 to have an adjustment facility 13 which is embodied so that the microwave shield 10 is able to be set and thus changed in its position in all three spatial directions (x-, y- and z-direction) relative to the flange 11.

Figure 2:
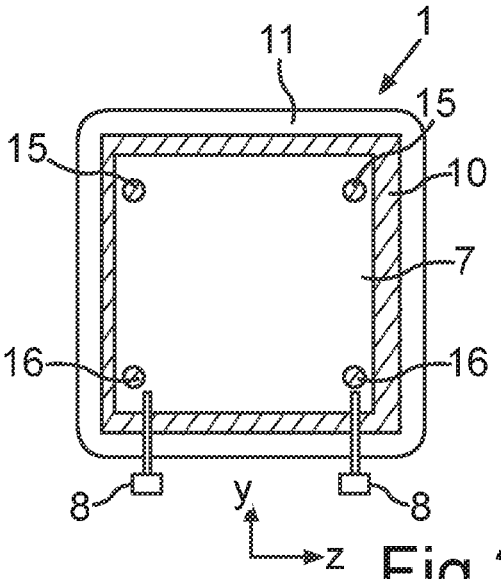
FIG. 2 shows a front view of the oven according to FIG. 1 with closed door, wherein only a carrier part of the door, as is connected to a microwave shield, is shown.

FIG. 2 shows the microwave oven 1 in a view towards the oven space 2, wherein the door 5 shown in the closed state is merely shown with the carrier part 7 and the microwave shield 10.

The adjustment facility 13 comprises a number of, in the exemplary embodiment four, holes 15 and 16 (two upper holes and two lower holes in each case), which are embodied in the respective corner areas of the rectangular plate or the carrier part 7. Fastening elements, especially screws, can be passed through these holes 15, 16 in order to fasten the microwave shield 10 to the carrier part 7 releasably in a non-destructive manner. Through these holes 15, 16 with their design explained in greater detail below, in conjunction with the fastening elements, a part of the adjustment facility 13 is created, so that a setting of a relative position between the microwave shield 10 and the carrier part 7 in two spatial directions at right angles to one another, namely the y- and the z-direction and thus in a plane in parallel to the carrier part 7 can be made.

FIG. 2 shows an example of a situation here in which the microwave shield 10 is disposed and fastened off-center in relation to the dimensions and embodiments of the carrier part 7. This is made possible by the specific subcomponents of the adjustment facility 13, wherein, through the advantageous position shown in FIG. 2, quite specific requirements in respect of positional tolerances between the individual positions to be adapted to one another between the components are the most advantageous in respect of a smallest possible microwave energy escape from the oven space 2.

Figure 3:
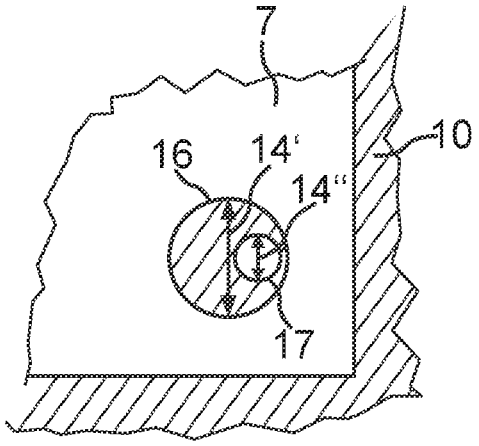
FIG. 3 shows an enlarged diagram of a part section of the view in FIG. 2.

Shown in FIG. 3 in this connection is an enlarged presentation of what is shown in FIG. 2 in the area of the hole 16. It can be seen in this figure that an internal diameter 14' of the hole 16 is larger than the external diameter 14" of a fastening element 17, such that a movement with play is possible. Preferably there is provision for the internal diameter 14' to be greater by at least 1.2 times, especially at least 1.5 times, especially by at least 2 times than the outer diameter 14". The same is also true in the dimension relationships between the holes 16 and the associated fastening elements passed through them in each case. Through this a relative position change is created, which in this plane can be made in a versatile and finely-adjusted way.

Figures 4A, 4B, 4C, 4D:
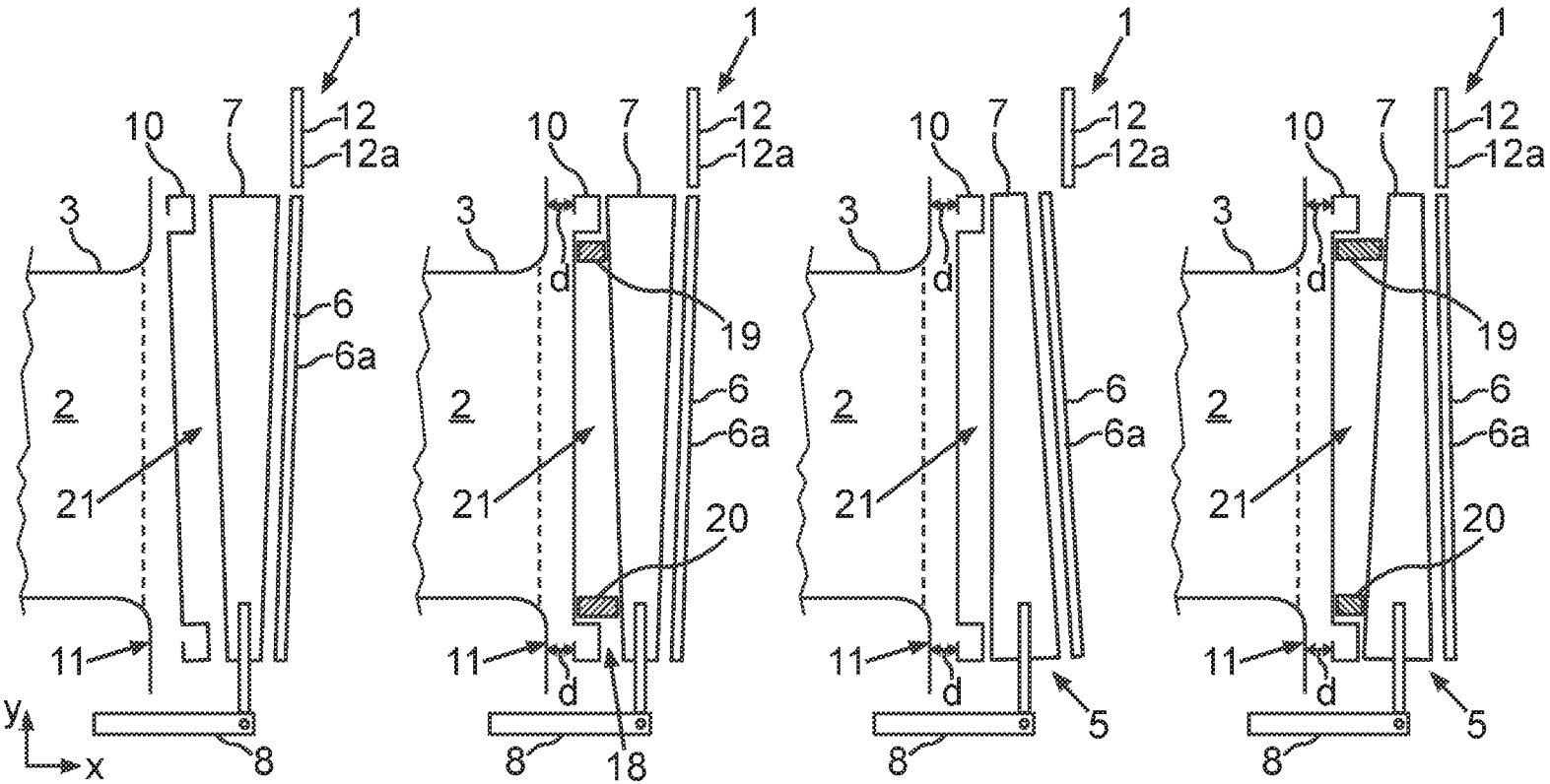
FIG. 4*a*-4*d* show schematic horizontal sectional diagrams of versions with misadjusted components of a door on one side and adjusted doors on the other side.

FIG. 4*a* shows an embodiment of the microwave oven 1 in a horizontal sectional diagram, in which for example the carrier part 7 is shown in a production tolerance exaggerated in its width and/or in an angled position. Through this the microwave shield 10 attached to it is accordingly disposed at an angle in relation to the flange 11. As can be seen in the diagram FIG. 4*a*, the distances d in the upper and lower area between the microwave shield 10 and the flange 11 are different. Therefore a less-than-optimum position of the microwave shield 10 is present, so that a large proportion of microwave energy could escape from the oven space 2 during operation of the microwave oven 1.

In order to rectify this misadjustment as well and thus be able to make a positional change in the third spatial direction and thus in the x-direction, the adjustment facility 13, in accordance with the diagram in FIG. 4*b*, has a distance setting device 18. The distance setting device 18 is embodied for setting of a relative position in a third spatial direction measured in the depth direction and thus in the x-direction of the microwave oven 1 between the microwave shield 10 and the flange 11.

In the exemplary embodiment in accordance with FIG. 4*b* the distance setting device 18 has a number of distance elements 19 and 20. These are disposed in the free space 21 between the microwave shield 10 and the carrier part 7. Through these distance elements 19 and 20 the distance in the third spatial direction is set so that the microwave shield 10 is disposed at a distance d that is as equal as possible from the flange 11 running around its circumference. Preferably the microwave shield 10 then thus extends in a plane in parallel to the flange 11.

FIG. 4*c* shows a horizontal sectional diagram in which a front plate 6 of the door 5 is disposed at an angle in relation to the panel 12. In order to additionally achieve a correspondingly flush and thus adjusted arrangement of the front side or outer side 6*a* in relation to the front side or outer side 12*a*, the distance elements 19 and 20, as are then shown in FIG. 4*d*, are designed to be multifunctional. These distance elements 19 and 20, of which the number is only to be understood as an example, then allow a versatile adjustment between different components and thus a comprehensive relative position setting between different components to be achieved. Thus a simultaneous position adjustment between components of the door 5 itself, especially of the carrier part 7 and the microwave shield 10 in respect of a defined and desired position setting between the microwave shield 10 and the flange 11 is just as possible as relative position setting between the door 5, especially of a front plate 6 permanently connected to the carrier part 7 to a front-side and door-external component, especially the panel 12.

In preferred versions there is provision for a fastening element 17, which can be included and used as a basis for example for different versions of a fastening element, to be disposed so as to engage within a distance element 19 and for these two separate parts to be positioned axially guided within one another.

Figure 5:
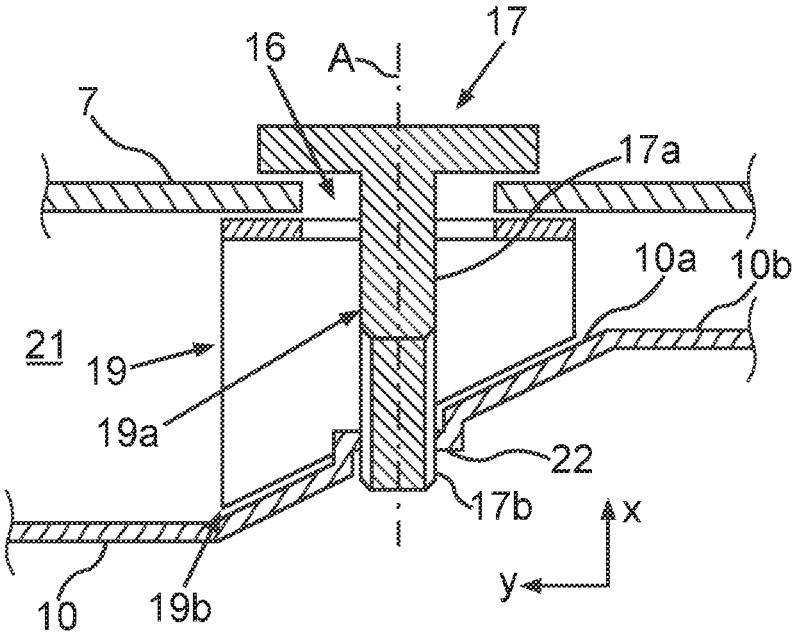
FIG. 5 shows a sectional diagram through a first exemplary embodiment of an adjustment facility.

A first exemplary embodiment relating thereto is shown in a cross-sectional diagram in FIG. 5. In this version a longitudinal axis A of the fastening element 17 extends in the direction of this third spatial direction and thus in the x-direction. The longitudinal extent and thus longitudinal axis of the distance element 19 is also to be seen accordingly.

In the exemplary embodiment shown the distance element 19 extends completely into the free space 21 and does not extend beyond said space. The fastening element 17 is embodied as a screw here, which extends with a screw shaft 17*a*, which preferably has the external diameter 14" through the hole 16, which preferably has the internal diameter 14'.

The distance element 19 has a bore 19*a* right through it, through which the screw shaft 17*a* fully extends. As can be seen, the distance element 19 has a wedge shape at an end 19*b* in its longitudinal extent measured in the third spatial direction, wherein the distance element 19 rests with this taper and thus this wedge shape on a taper 10*a* of an inner side 10*b* of the microwave shield 10. The screw which represents the fastening element 70 has at its front end of the screw shaft 17*a* a thread 17*b* which engages into a mating thread 22 in the taper 20*a* and thus a mechanical coupling is able to be effected. Through a movement of the distance element 19 in the y-z plane relative to the taper 10*a* the distance and thus the spacing in the x-direction between the carrier part 7 and the microwave shield 10 is changed. By screwing in the screw or the fastening element 17 this position can be fixed.

Figure 6:
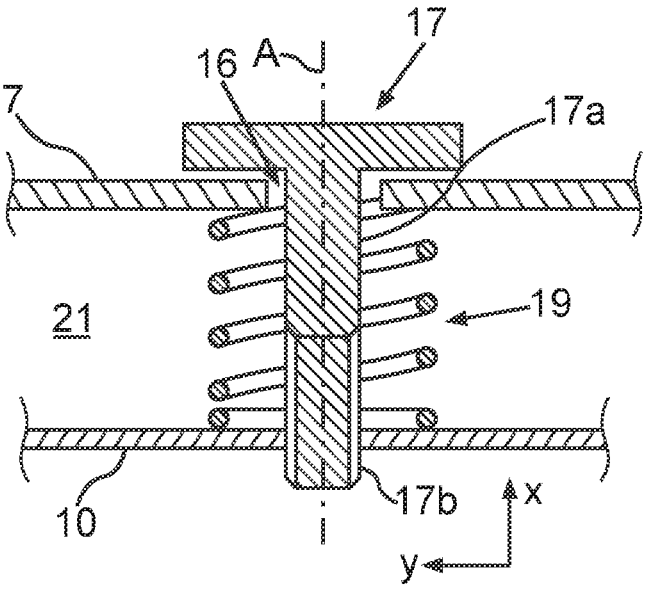
FIG. 6 shows a sectional diagram through a second exemplary embodiment of an adjustment facility.

In FIG. 6 the distance element 19 is embodied in an alternative version as a spiral spring which likewise is disposed completely within the free space 21. In this embodiment the microwave shield 10 also does not have any taper 10*a* in the area of the mechanical coupling with the fastening element 17. In that this spiral string which represents the distance element 19 is able to be continuously changed in its length in the direction of the longitudinal axis A, an individual change in distance in the third spatial direction and thus in the x-direction between the carrier part 7 and the microwave shield 10 can also be made. Here too the corresponding geometry of the hole 16 is similar to the embodiment and the explanations for FIGS. 2 and 3 and for FIG. 5, so that here too an individual relative position setting in all three spatial directions is made possible.

Figure 7:
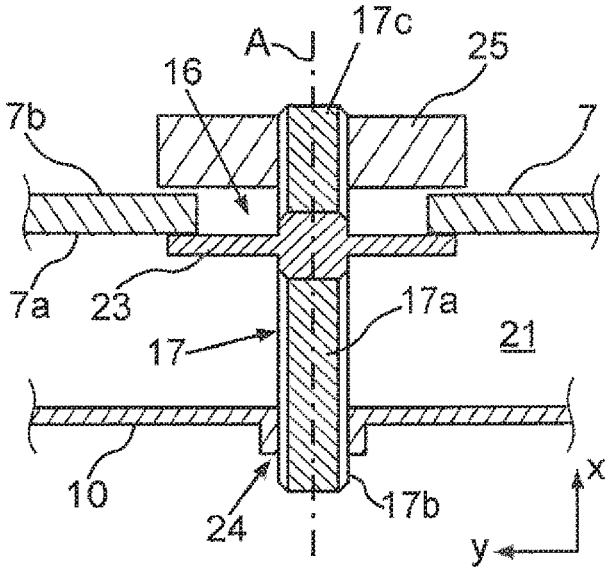
FIG. 7 shows a sectional diagram through a third exemplary embodiment of an adjustment facility.

In FIG. 7 a cross-sectional diagram is shown in a further exemplary embodiment, in which the fastening element 17 and the distance element 19 are present integrated into one component. Here too the fastening element 17 is once again designed as a type of screw which has a thread 17*b*. This is embodied with a shaft-type base part or a screw shaft 17*a* on the one end of which the anchoring area is embodied as a thread 17*b* for fastening in the microwave shield 10 is present. In addition a plate-shaped collar 23 running at least partly around the base section or the screw shaft 17*a* is embodied. This collar 23 rests on an inner side 7*a* of the carrier part 7 facing towards the microwave shield 10 in the installed state. A distance in this third spatial direction between the microwave shield 10 and the carrier part 7 is able to be set as a function of the relative position of the anchoring area or of the thread 17*b* in a receptacle 24 in the microwave shield 10. Depending on how the penetration depth of the thread 17*b* into the receptacle 24 is thus embodied, the distance setting can be performed in this third spatial direction and thus in the x-direction.

In addition there is provision for the fastening element 17 to have a coupling area 17*c* at an end lying opposite the thread 17*b*, which is embodied for coupling with a fixing element 25. In particular the coupling area 17*c* is also embodied as a thread and the fixing element is designed as a nut. In the mounted state the fixing element 25 rests against an outer side 7*b* of the carrier part 7 facing away from the microwave shield 10. The set relative position in the x-direction between the carrier part 7 and the microwave shield 10 is then fixed by said element.

Figure 8:
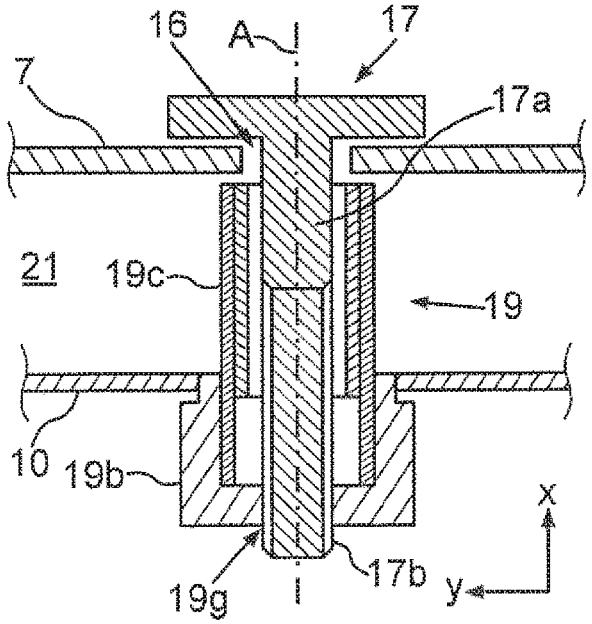
FIG. 8 shows a sectional diagram through a fourth exemplary embodiment of an adjustment facility.

FIG. 8 shows a cross-sectional diagram in a further exemplary embodiment, in which a multi-part distance element 19 is provided. In this version a first sub-element 19*g* extends outside the free space 21 and on the side of the microwave shield 10 facing away from the carrier part 7. The first sub-element 19*g* is connected to the microwave shield 10 so that it can be released non-destructively, in particular is screwed into it. It can however also be connected thereto so that it cannot be released non-destructively, or pressed or welded or glued into it. A second sub-element 19*c* of the distance element 19 essentially extends in the free space 21 and is connected to the second sub-element sub-element 19*c* such that these two sub-elements 19*g* and 19*c* can move to change their position in relation to one another in the direction of the axis A and thus also in the direction of the third spatial direction. In particular there is provision for the second sub-element 19*c*, at its end facing towards the first sub-element 19*g* to have an external thread, with which it is able to be coupled and screwed to an inner thread of the first sub-element 19*g*.

It can also be seen that the fastening element 17, especially a screw, once again extends through a bore through the two sub-elements 19*g* and 19*c* and is anchored in a receptacle area 19*d* of the first sub-element 19*g*, especially screwed into it. Here too a distance setting is thus able to be achieved and fixed in the third spatial direction very easily and also very precisely and permanently. In relation to the relative position setting in x- and z-direction, reference may once again be made to the information given for FIG. 2 and FIG. 3, so that also with the information in accordance with FIG. 7 and FIG. 8 a relative positional change is able to be made by the adjustment facility 13 between the microwave shield 10 and the carrier part 7 and thus also a corresponding positional change in all three spatial directions between the microwave shield 10 and the flange 11 is made possible.

Figure 9:
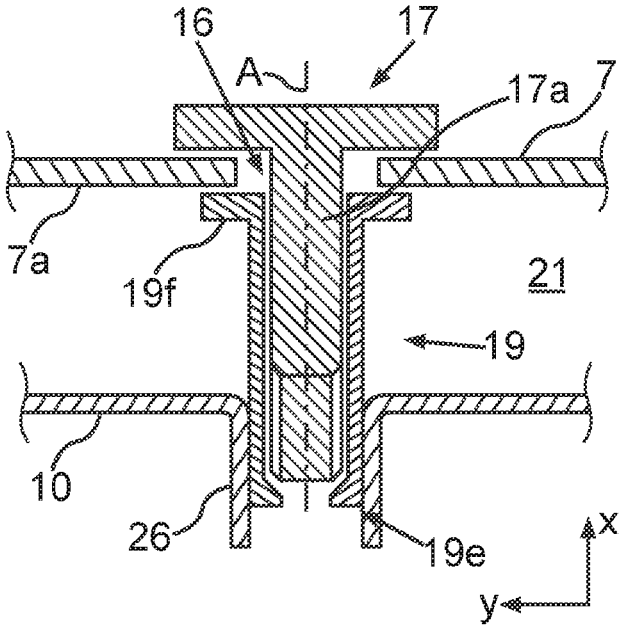
FIG. 9 shows a sectional diagram through a fifth exemplary embodiment of an adjustment facility.

FIG. 9 shows a further exemplary embodiment of a cross-sectional diagram in which the distance element 19 is embodied as a type of plug. The distance element 19 has a spreadable front end 19*e*, which engages into a receptacle 26 in the microwave shield 10 or is pushed into said receptacle. On a rear end facing towards the carrier part 7 a claw 19*f* is embodied which is supported on the inner side 7*a* of the carrier part 7. Here too the fastening element 17 with the shaft 17*a* is passed axially through the distance element 19 lying within it. Depending on how far the plug-type distance element 19 penetrates into the receptacle 26, the distance in the x-direction is able to be set. This distance then set can be fixed by the fastening element 17 being pushed in the axial direction relative to the distance element 19 into said element and through this the front end 19*e* being spread out and wedged into the receptacle 26.

In the version in FIG. 8 it is also possible for the principle to be reversed. Then the second sub-element 19*c* is fastened with an outer thread to the microwave shield 10 and additionally bears the thread for the fastening element 17. The first sub-element 19*g* then only has one inner thread for the second sub-element 19*c* and a through-hole for the fastening element 17. Likewise the sub-element connected to the microwave shield 10 can be embodied in one piece with this microwave shield 10. Preferably there is provision for the screw thread to be embodied as a self tapping thread in the second sub-element 19*c*.

Figure 10:
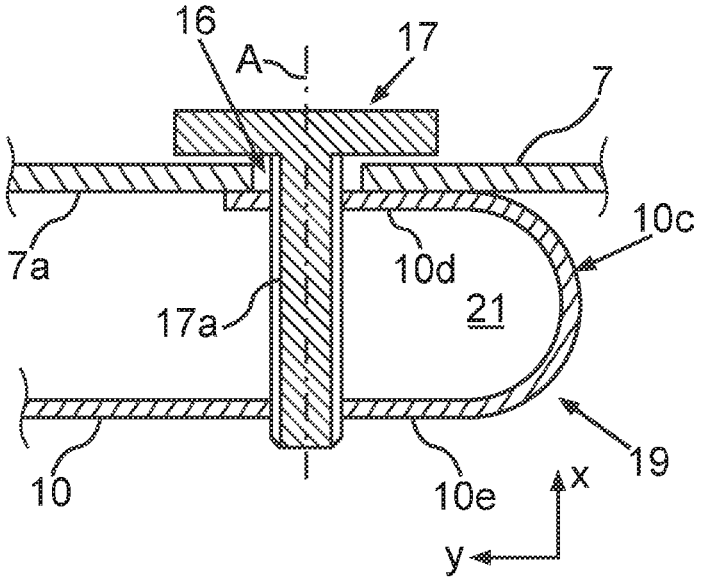
FIG. 10 shows a sectional diagram through a sixth exemplary embodiment of an adjustment facility.

In FIG. 10 an exemplary embodiment is shown in a further cross-sectional diagram in which the microwave shield 10 has an integrated distance element 19, wherein this is embodied by a bent-over free end or an edge respectively. For this purpose this edge is formed as a U-shaped bent tab. Both arms 10*d* and 10*e* of the U shape are connected to the fastening element 17 or said element extends in the third spatial direction and thus in the x direction through the two arms 10*d* and 10*e*. As can be seen from the diagram in FIG. 10, one arm 10*d* rests against the inner side 7*a* of the carrier part 7, while the other arm 10*e* is disposed at a distance from it. In that the two arms 10*d* and 10*e* can deform in the x-direction and can thus move towards one another or can move away from one another, the distance between the microwave shield 10 and the carrier part 7 is able to be changed in this third spatial direction and can be fixed by the fastening element 17.

Preferably the arm 10*d* is embodied with a cut thread into which the fastening element 17 engages. As soon as the fastening element 17 and especially the screw then comes into contact with the second arm 10*e* during installation, it cuts a further thread into said arm. Through this self-tapping embodiment of the fastening element 17 the position of the previously bent tab is fixed. The clamping of the support part 7 takes place at the end of the tab.

What is claimed is:

1. A microwave oven, comprising:

a housing, which surrounds an oven space and has a flange configured to delimit a loading opening for the oven space, a door configured to close off the oven space, said door being disposed movably on the housing, a microwave shield, which is disposed on the door and disposed at a distance in front of the flange, when the door is closed, and at least one adjustment facility configured to adjust the microwave shield such that a position of the microwave shield is able to be set in three spatial directions relative to the flange via the at least one adjustment facility.

2. The microwave oven of claim 1, wherein the door has a carrier part which forms a part of the at least one adjustment facility and on which the position of the microwave shield is adjustable in at least two of the three spatial directions relative to the carrier part.

3. The microwave oven of claim 2, wherein the two spatial directions extend in a plane parallel to the microwave shield.

4. The microwave oven of claim 2, wherein the microwave shield is disposed on the carrier part so that it can be released without destroying it.

5. The microwave oven of claim 2, wherein the carrier part is a plate.

6. The microwave oven of claim 2, further comprising fastening elements configured to pass through holes of the carrier part for fastening the microwave shield to the carrier part, each said fastening element being defined by an external diameter, wherein the holes are each defined by an internal diameter which is greater by at least 1.2 times than the external diameter of a base part of the fastening element, which extends through the hole in an installed end state.

7. The microwave oven of claim 6, wherein the internal diameter is greater by at least 1.5 times than the external diameter of the base part of the fastening element.

8. The microwave oven of claim 1, wherein a depth direction of the microwave oven between the microwave shield and the flange defines a third one of the three spatial directions, said at least one adjustment facility having a distance setting device configured to set a relative position in the third spatial direction.

9. The microwave oven of claim 8, wherein the door has a carrier part on which the microwave shield is disposed, said distance setting device having at least one distance element sized to extend in a free space between the microwave shield and the carrier part of the door.

10. The microwave oven of claim 9, further comprising a fastening element configured to pass through a hole of the carrier part for fastening the microwave shield to the carrier part, said fastening element extending axially in the third spatial direction through the distance element.

11. The microwave oven of claim 9, wherein the distance element has asymmetrical shape at least in one of the three spatial direction and is configured for movement in the free space in a plane parallel to the carrier part and the microwave shield, said distance element having a variable distance in the third spatial direction as a function of the position of the distance element in relation to the microwave shield and the carrier part.

12. The microwave oven of claim 11, wherein the distance element has an end, as viewed in a longitudinal extent thereof in the third spatial direction, which end is embodied in a wedge shape and rests against a tapered inner side of the microwave shield, with a change in distance of the distance element being realized by relative movement of the end along the tapered inner side.

13. The microwave oven of claim 9, wherein the distance element for setting a distance in the third spatial direction has a variable length.

14. The microwave oven of claim 13, wherein a change in length of the distance element is reversible.

15. The microwave oven of claim 9, wherein the distance element is a spring.

16. The microwave oven of claim 9, wherein the distance element is a spiral spring.

17. The microwave oven of claim 9, further comprising a fastening element configured to pass through a hole of the carrier part for fastening the microwave shield to the carrier part, said distance element having two sub-elements movable relative to one another in the third spatial direction, a first one of the sub-elements being disposed in a fixed location on the microwave shield and having a receptacle area for fixed-location mechanical connection with the fastening element, and a second one of the sub-elements being disposed in the free space and engaging into and coupled with the first sub-element.

18. The microwave oven of claim 10, wherein the distance element is integrated into the fastening element.

19. The microwave oven of claim 18, wherein the fastening element has a shaft-like base section having one end configured with an anchoring area for fastening the fastening element in the microwave shield and a plate-shaped collar which at least partly runs around the base section and which is supported on an inner microwave-shield-facing side of the carrier part, wherein a distance in the third spatial direction between the microwave shield and the carrier part is adjustable as a function of a relative position of the anchoring area in a receptacle in the microwave shield.

20. The microwave oven of claim 19, further comprising a fixing element configured to fix a set position of the fastening element, said base section having another end lying opposite the anchoring area and having a coupling area for the fixing element, said fixing element resting against an outer side of the carrier part facing away from the microwave shield in an installed state.

21. The microwave oven of claim 10, wherein the distance element is embodied in the form of a plug and extends with a spreadable front end into a receptacle in the microwave shield, said distance element having a rear end with a claw for support on a microwave-shield-facing inner side of the carrier part of the door, wherein a distance in the third spatial direction between the microwave shield and the carrier part is able to be set by a penetration depth of the front end of the distance element into the receptacle and is able to be fixed by inserting the fastening element into the front end of the distance element in the receptacle by spreading out the front end.

22. The microwave oven of claim 10, wherein the distance element is integrated into the microwave shield and is embodied as a U-shaped bent tab which is deformable on an edge side in the third spatial direction, said fastening element extending in the third spatial direction through both arms of the U-shaped bent tab, with one arm of the U-shaped bent tab resting against a microwave-shield-facing inner side of the carrier part.

* * * * *